United States Patent [19]

Matsuo et al.

[11] Patent Number: 4,969,347

[45] Date of Patent: Nov. 13, 1990

[54] CHOCKLESS ROLLING MILL

[75] Inventors: Giichi Matsuo; Akio Mehara; Fumiyuki Yamaguchi, all of Tokyo, Japan

[73] Assignee: NKK Corporation, Tokyo, Japan

[21] Appl. No.: 354,431

[22] PCT Filed: Dec. 18, 1987

[86] PCT No.: PCT/JP87/00990

§ 371 Date: Apr. 3, 1989

§ 102(e) Date: Apr. 3, 1989

[87] PCT Pub. No.: WO89/01368

PCT Pub. Date: Feb. 23, 1989

[30] Foreign Application Priority Data

Aug. 18, 1987 [JP] Japan ..... 62-203441

[51] Int. Cl.[5] ..... B21B 31/18; B21B 31/26

[52] U.S. Cl. ..... 72/247; 72/248

[58] Field of Search ..... 72/244, 247, 237, 199, 72/245, 248

[56] References Cited

U.S. PATENT DOCUMENTS

| | | | |
|---|---|---|---|
| 2,774,263 | 12/1956 | Leufven | 72/248 |
| 4,248,074 | 2/1981 | Fuhrmann et al. | 72/247 |
| 4,581,911 | 4/1986 | Shinomoto | 72/247 |
| 4,589,269 | 5/1986 | Michaux | 72/247 |

FOREIGN PATENT DOCUMENTS

| | | | |
|---|---|---|---|
| 872482 | 4/1953 | Fed. Rep. of Germany | 72/247 |
| 1808038 | 12/1969 | Fed. Rep. of Germany | 72/244 |
| 2227063 | 11/1974 | France | 72/244 |
| 17-4763 | 2/1942 | Japan | 72/248 |
| 70258 | 6/1975 | Japan | 72/244 |
| 635008 | 3/1950 | United Kingdom | 72/240 |

*Primary Examiner*—Daniel C. Crane

*Attorney, Agent, or Firm*—Frishauf, Holtz, Goodman & Woodward

[57] ABSTRACT

Upper and lower eccentric sleeves 2*a*U and 2*a*B with respective worm wheels are provided as a pair in respective drive side and operating side housings 1*b* and 1*a* and support the necks of respective upper and lower rolls 5U an 5B via the bearings. These pairs of eccentric sleeves are synchronically rotated in respect to one another via a worm mechanism so as to effect the draft adjustment.

3 Claims, 2 Drawing Sheets

CHOCKLESS ROLLING MILL

FIELD OF THE INVENTION

This invention relates to a chockless rolling mill, which dispenses with any roll chock.

DESCRIPTION OF THE RELATED ART

The usual rolling mill requires the draft adjustment and axial adjustment of rolls. Therefore, upper and lower rolls are supported via bearings in chocks provided in respective driving and operating side housings. The draft adjustment is done by vertically displacing the upper or lower roll with a draft screw mounted in the housing. The axial adjustment is done by displacing the upper or lower roll together with the chock thereof in the axial direction. In the usual rolling mill, however, the chocks supporting the upper and lower rolls are mounted in the housings. Therefore, the housings are large in size. In addition, since the vertical and axial displacement of the roll is effected via the chock, the construction is complicated, and also the maintenance involves a large number of steps.

Meanwhile, recent mass production steel rod and billet rolling equipment calls for compact and maintenance-free rolling mills, which are capable of high accuracy rolling under high pressure.

An object of the invention is to provide a rolling mill, which can meet the demand noted above and dispenses with any roll chock.

SUMMARY OF THE INVENTION

According to the invention, there is provided a chockless rolling mill, which comprises upper and lower eccentric sleeves with worm wheels rotatably provided as pair in respective drive side and operating side housings such that their axial movement is restricted and supporting necks of respective upper and lower rolls, worm shafts with respective upper and lower worms provided as a pair and in mesh with the worm wheels of the respective upper and lower eccentric sleeves for causing rotation thereof in opposite directions for draft adjustment and a rotating mechanism for rotating the worm shafts in the drive side and operating side in synchronism to each other.

The upper and lower eccentric sleeves with the respective worm wheels, which are rotatably provided in the respective drive side and operating side housings and support the necks of the upper and lower rolls via the bearings, are rotated in synchronism to each other via the worm mechanism to effect draft adjustment.

Thus, chocks, which dictate large housing size and a large number maintenance steps, are dispensed with to provide a compact and maintenance-free rolling mill. Further, rolling under high pressure and with high accuracy can be realized by causing displacement of the upper and lower rolls vertically symmetrically on the opposite sides of a path line, which is held constant.

DETAILED DESCRIPTION OF THE PREFERRED EMBODIMENTS

Figure 1:
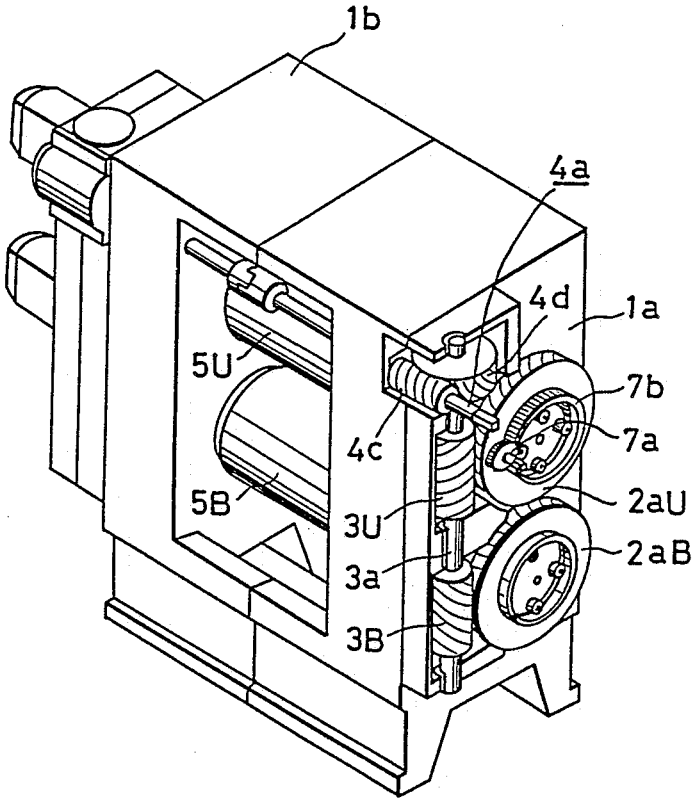
FIG. 1 is a perspective view showing an embodiment of the invention.
Figure 2:
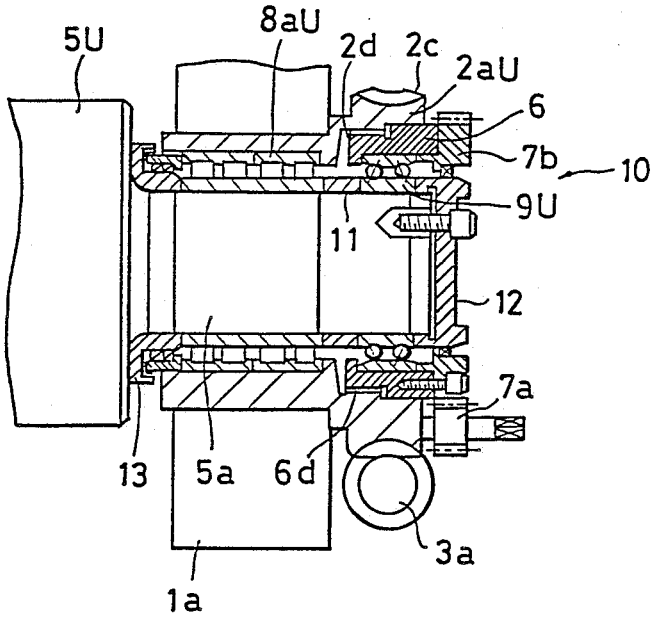
FIG. 2 is a sectional view showing an eccentric sleeve and nearby arrangements.

Now, an embodiment of the invention will be described with reference to FIGS. 1 and 2.

In the rolling mill according to the invention, vertical draft adjustment mechanisms of upper and lower rolls 5U and 5B are symmetrically disposed in respective operating side and drive side housings 1*a* and 1*b*, so the description will only be made with respect to operating side housing 1*a*. Further, upper and lower roll draft adjustment mechanisms of operating side housing 1*a* are vertically symmetrical to one another, so the majority of the description will concern the upper roll draft adjustment mechanism.

Eccentric sleeve 2*a*U is rotatably mounted in operating side housing 1*a* such that its axial movement is restricted. A portion of eccentric sleeve 2*a*U extending from housing 1*a* has coaxial worm wheel 2*c*. Also, radial bearing 8*a*U is employed to support neck 5*a* of upper roll 5U.

Upper and lower eccentric sleeves 2*a*U and 2*a*B have respective worm wheels 2*c* in mesh with respective worms 3U and 3B provided on worm shaft 3*a* rotatably supported in housing 1*a*. When worm shaft 3*a* is rotated, upper and lower eccentric sleeves 2*a*U and 2*a*B are rotated in opposite directions from one another. Worm shaft 3*a* is synchronically rotated by means of rotating mechanism 4*a*, in respect to worm shaft 3*b* (not shown) provided in drive side housing 1*b*, whereby the draft adjustment of the operating side can be synchronically made with respect to the drive side. The rotating mechanism consists of worm wheel 4*d* mounted on top of worm shaft 3*a* and worm 4*c*. The rotating mechanism of the drive side is structured similar to that of the operating side such that worm 4*c* is rotated by the corresponding worm of the drive side.

Now, axial adjustment mechanism 10 will be described. This mechanism consists of screw sleeve 6 and pinion-and-gear mechanisms 7*a* and 7*b* for rotating this threaded sleeve.

Screw sleeve 6 has outer screw 6*d* in mesh with inner screw 2*d* formed in eccentric sleeve 2*a*U. Thrust bearing 9U is assembled in screw sleeve 6. Thrust bearing 9U has its outer race held by a stepped portion of spur gear 7*b* secured to a side surface of screw sleeve 6. The inner race of bearing 9U is held by cover 12 secured to an end surface of roll neck 5*a*. Spacer 11 is provided between the inner race of bearing 9U and the inner race of radial bearing 8*a*U. Horn-like member 13 is provided between the radial bearing inner race and the stepped portion of upper roll 5U. Pinion 7*a* in mesh with spur gear 7*b*, is rotatably mounted on the end surface of eccentric sleeve 2*a*U.

Thus, by turning pinion 7*a*, spur gear 7*b* rotates screw sleeve 6, thereby allowing screw 6*d* to be displaced relative to eccentric sleeve 2*a*U in a forward or backward direction, whereby thrust bearing 9U displaces upper roll 5U due to movement of screw sleeve 6 in an axial direction so as to effect the axial adjustment upper roll 50. During this axial adjustment, the inner race of the radial bearing 8*a*U slides over the roll neck 5*a*.

While the above example of an axial adjustment mechanism is assembled in upper roll 5U, it is also possible to assemble such an axial adjustment mechanism in lower roll 5B.

This rolling mill may be used for either a horizontal or a vertical type. Further, it may be applied to coarse, intermediate, or finish rolling.

In the case of the chockless rolling mill according to the invention, unlike the prior art rolling mill, no chock roll is provided in the housing. It is thereby possible to provide a compact rolling mill. Further, it is possible to reduce the maintenance costs due to the simplification of construction. Further, the draft adjustment of the upper and lower rolls can be effected by vertically displacing the upper and lower rolls symmetrically with respect to the pass line, which is held constant. Thus, it is possible to obtain rolling under high pressures and with a high degree of accuracy.

We claim:

1. A chockless rolling mill which comprises a pair of upper and a pair of lower eccentric sleeves each having peripheral surfaces forming worm wheels and, with the sleeves in each pair being rotatably provided in respective drive side and operating side housings of the rolling mill such that axial movement of the sleeves is restricted, said eccentric sleeves being arranged in said housings to support the necks of respective upper and lower rolls, a pair of worm shafts, each with respective upper and lower worms, provided in said respective drive side and operating side housings of said rolling mill and in mesh with said worm wheels of said respective upper and lower eccentric sleeves for causing said pair of eccentric sleeves to rotate in opposite directions to effect a roll draft adjustment, a rotating mechanism for synchronously rotating said worm shaft in said drive side with said worm shaft in said operating side, and an axial adjustment means for causing one of said upper and lower rolls to be axially displaced, comprising a screw sleeve threadedly coupled to said eccentric sleeve, means for rotating said screw sleeve relative to said eccentric sleeve so as to effect axial movement of said screw sleeve such that it translates in a direction parallel to the axis of said one of said upper and lower rolls, and means to drivingly couple said screw sleeve to said one of said upper and lower rolls for movement therewith along with the axis of such one of said upper and lower rolls so that said one of said upper and lower rolls is axially moved relative to said eccentric sleeves.

2. A chockless rolling mill according to claim 1, wherein said screw sleeve is mounted within said eccentric sleeve, said screw sleeve having external threads in mesh with internal threads of said eccentric sleeve.

3. A chockless rolling mill according to claim 1, wherein said coupling means comprises a thrust bearing having its outer portion received within said screw sleeve, and its inner portion rotatably receiving a neck of said one of the upper and lower rolls.

* * * * *

UNITED STATES PATENT AND TRADEMARK OFFICE

CERTIFICATE OF CORRECTION

PATENT NO. : 4,969,347

DATED : November 13, 1990

INVENTOR(S) : MATSUO et al

It is certified that error appears in the above-identified patent and that said Letters Patent is hereby corrected as shown below:

Title page, under "FOREIGN PATENT DOCUMENTS", change the Japanese reference "17-4763" to --42-4763--.

Signed and Sealed this

Thirtieth Day of June, 1992

*Attest:*

DOUGLAS B. COMER

*Attesting Officer*

*Acting Commissioner of Patents and Trademarks*